US006546655B1

(12) United States Patent
Hillstrom

(10) Patent No.: US 6,546,655 B1
(45) Date of Patent: Apr. 15, 2003

(54) LATCH ASSEMBLY FOR SIGN HAVING FLIP DISPLAY

(75) Inventor: Brian J. Hillstrom, Milford, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 0 days.

(21) Appl. No.: 09/793,059

(22) Filed: Feb. 26, 2001

(51) Int. Cl.[7] ..... G09F 7/02
(52) U.S. Cl. ..... 40/611; 40/622; 292/54
(58) Field of Search ..... 40/5, 611, 612, 40/620, 622; 411/508, 509, 913; 292/54, 31, 202, 204, 210, 240, 241

(56) References Cited

U.S. PATENT DOCUMENTS 286,045 A * 10/1883 McCool ..... 40/620
869,631 A * 10/1907 Haddock ..... 292/241
1,743,434 A * 1/1930 Cramer ..... 292/194
1,893,567 A * 1/1933 Solomita ..... 40/611 X
2,110,128 A * 3/1938 Kent ..... 40/611 X
2,388,180 A * 10/1945 Pulver ..... 40/611 X
3,081,570 A * 3/1963 Bock ..... 40/620
3,315,392 A * 4/1967 Edwards ..... 40/622 X
3,747,975 A * 7/1973 McGregor ..... 292/202
4,179,144 A * 12/1979 Henderson ..... 292/202
4,397,487 A * 8/1983 Guttman ..... 292/202
4,611,841 A * 9/1986 Ravinet ..... 292/241
4,813,726 A * 3/1989 Ravinet ..... 292/204
5,791,752 A * 8/1998 Hartman ..... 40/611 X
6,378,232 B1 * 4/2002 Creech ..... 40/611 X

* cited by examiner

*Primary Examiner*—D. Glenn Dayoan
*Assistant Examiner*—Patricia Engle
(74) *Attorney, Agent, or Firm*—Harness, Dickey & Pierce, P.L.C.

(57) ABSTRACT

A latch assembly for use in a flip panel sign display is disclosed. The latch assembly includes a latch pin releasably coupled to the sign panel in a manner to prevent relative rotation therebetween. A latch is disposed an end of the latch pin. The latch pin includes a neck portion and an end portion, the neck portion having a particular cross-sectional configuration which prevents relative rotation in the side panel. The latch is rotatably supported on the end portion and capable of rotation between a locked position which retains the flip panels in a desired configuration and an unlocked position which permits relative positioning of the flip panels.

21 Claims, 4 Drawing Sheets

FIG. 7.
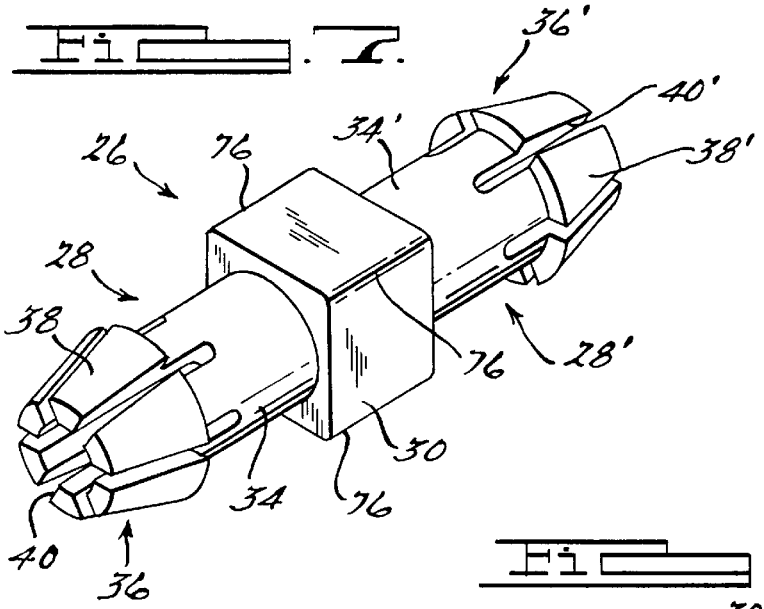
FIG. 8.
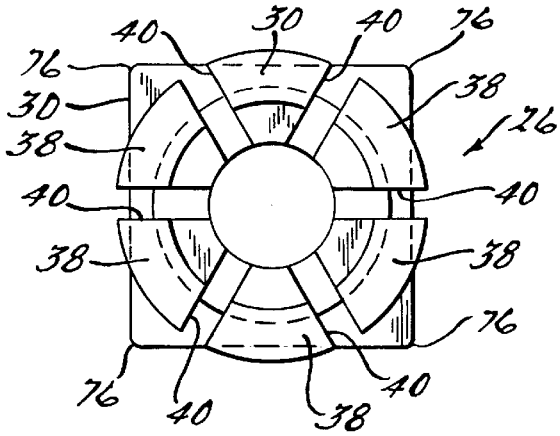
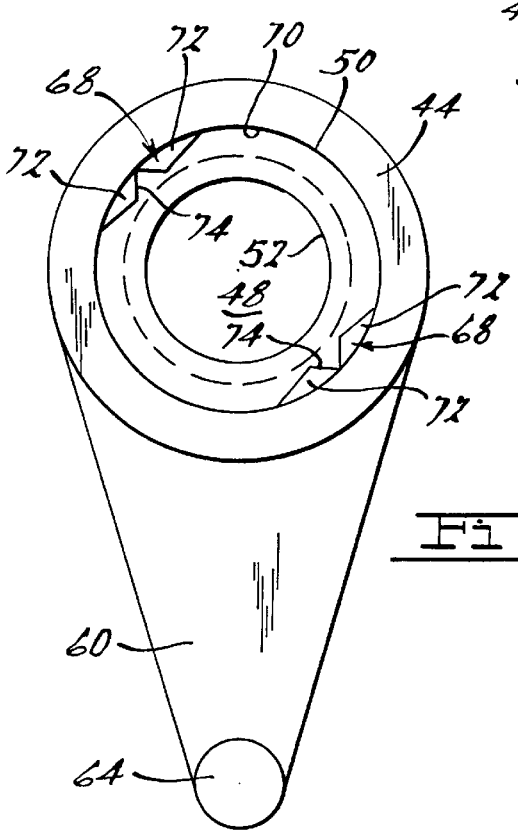
FIG. 9.

LATCH ASSEMBLY FOR SIGN HAVING FLIP DISPLAY

BACKGROUND OF THE INVENTION

1. Technical Field

The present invention relates generally to a mounting device for signs, and more particularly to an improved latch assembly for selectively retaining and supporting a latch associated with a flip display of a sign in desired configuration.

2. Discussion of Related Art

Commercial signs are designed to display advertising and images for products or services. However, some information or images related to the products or services may vary over the duration of time in which the sign is viewed by consumers. In certain applications, the fluctuation of the information requires frequent changes directly on the sign. For example, the price of a product or the time of a service, such as a viewing of a movie, may fluctuate. Many signs provide a manner in which information on the sign can be displayed but cannot easily be modified.

Signs commonly used to display frequently changing information may include flip displays that allow changes in the information or images. Flip displays have a plurality of panels bearing alphanumeric information or images. The panels are located next to each other so that one panel can be flipped to change the information or image displayed. For example, if two panels are next to each other, a first panel located in an upper panel position bears the upper half of a number upon it and the second panel located in a lower panel position bears the lower half of a number upon it such that the two panels form a complete number. Additional panels bearing additional information or images are located beneath the first and second panels, stacked and hidden out of view. This set of flip panels is arranged to allow flipping of each panel from one position to another. Thus, the second panel can be flipped into an upper panel position over the first panel, thereby exposing a third panel in the lower panel position and the second side of the second panel in the upper panel position. With the panels retained in this configuration, information or images on the third panel and newly exposed second side of the second panel are viewed.

A latch or turn piece is located adjacent the flip panels and positionable to retain the panels in a desired configuration. More specifically, each panel can be flipped when the latch which retains the panels or stacks the panels against the sign is moved from a locked position to an unlocked position. Conventional latches are secured to the sign with a rivet or similar fastener. While such a latch assembly has provided an adequate means for retaining the flip display in a desired configuration, several drawbacks have been realized. For example, the head of a riveted fastener may disrupt the information displayed on the sign. Furthermore, it can be difficult to control the friction generated at the interface of the sign and the latch, whereby too much or too little friction is provided at the latch/sign interface. Furthermore, in certain configurations where a single rivet is used to support a pair of latches disposed on opposite sides of the sign, certain undesirable rotational coupling between the pair of latches occur. As such, the rivet or support moves and rotates as a result of the rotation of the first latch, which in turn rotates the second latch. In view of these and other drawbacks of conventional latch assemblies, there is a need for an improved latch assembly for use on a display sign having a flip display which allows independent rotation of each lever.

SUMMARY OF THE INVENTION

It is therefore an object of this invention to provide an improved latch assembly to rotatably support a pair of latches for retaining flip displays on a sign. It is another object of the present invention to provide an improved latch assembly which is inexpensive to manufacture, simple to install and easy to operate. These and other objects are provided by a latch assembly and sign display apparatus. In a preferred embodiment, the latch assembly includes a latch pin having a neck interconnecting a pair of axle portions and a pair of levers rotatably supported on the axle portions. The latch assembly permits independent rotation of one lever while the other lever remains in a stationary position.

BRIEF DESCRIPTION OF THE DRAWINGS

The various advantages of the present invention will become apparent to one skilled in the art by reading the following specification and subjoined claims and by referencing the drawings in which:

FIG. 7 is a perspective view of the latch pin shown in FIG. 3;

FIG. 8 is an end view of the latch pin shown in FIG. 7;

FIG. 9 is a perspective view of an alternate embodiment for the latch pin shown in FIG. 3;

DETAILED DESCRIPTION OF THE PREFERRED EMBODIMENT

Figure 1:
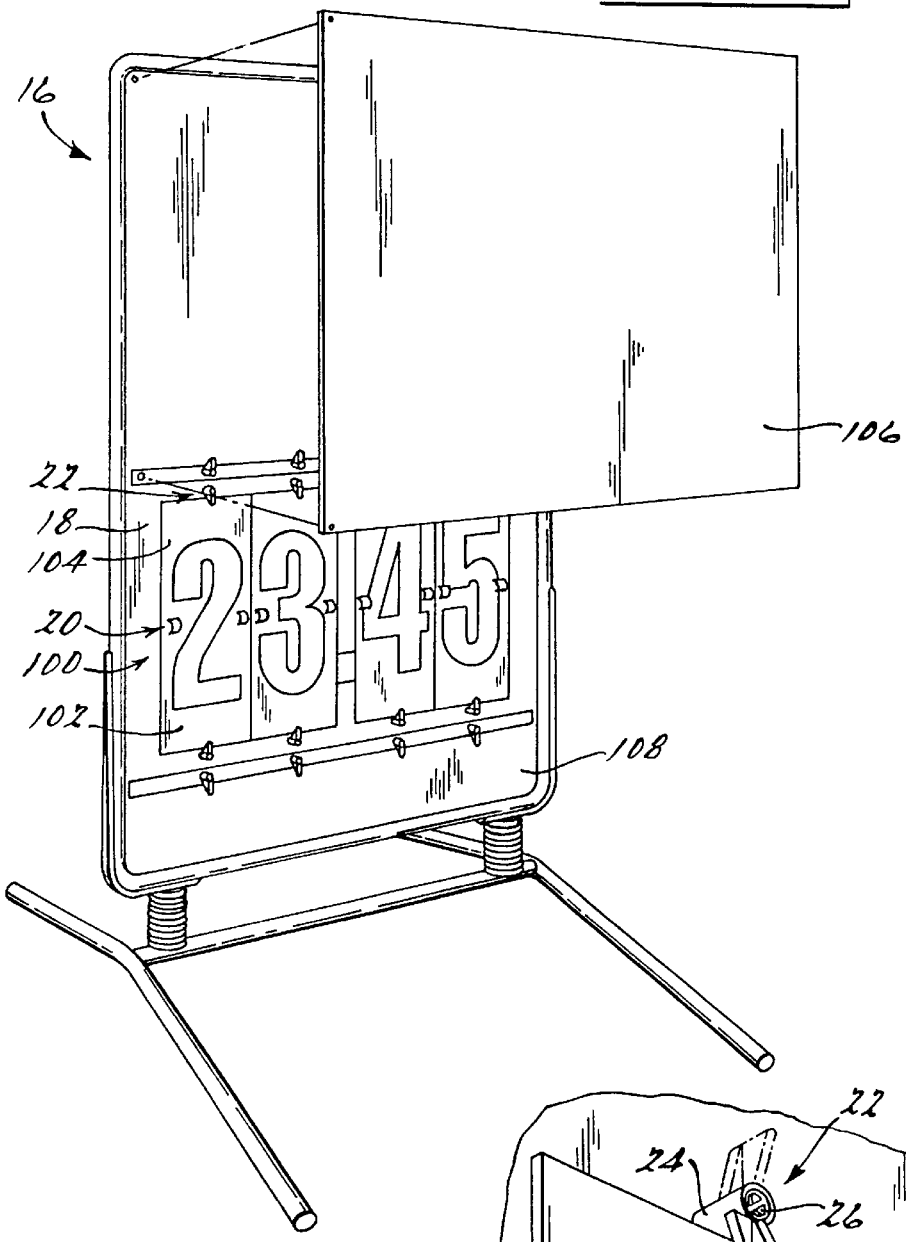
FIG. 1 is a perspective view of a sign having a flip display that utilizes the latch assembly of the present invention.
Figure 2:
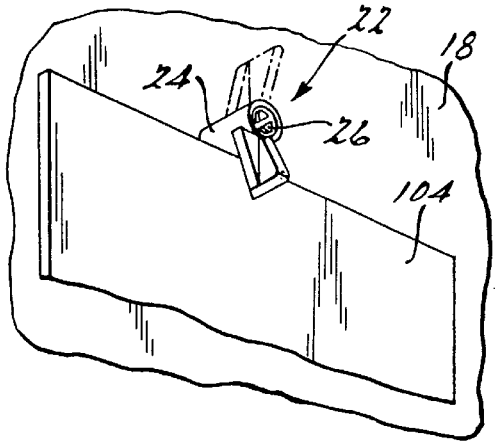
FIG. 2 is a perspective view showing a first preferred embodiment of a latch assembly in accordance with the present invention.

With reference to the drawings and in particular FIGS. 1 and 2, a display sign 16 is illustrated having a sign panel 18 and a plurality of flip displays 100. Each flip display 100 includes a set of flip panels 102 and 104 which when combined form a desired alphanumeric representation. Panels 102, 104 are arranged in a stacked manner to form a conventional flip display 100 that can be modified by rotating the individual flip panels.

Hinge assembly 20 interconnects flip panels 102, 104 and releasably secures the flip display 100 to the sign panel 18. The panel 102 is shown in a lower panel position and the panel 104 is shown in an upper panel position above. A latch pin assembly 22 is disposed adjacent a side of flip display 100 opposite hinge assembly 20 and functions to selectively retain the panels 102, 104 of flip display 100 in a desired configuration. As can be seen in FIG. 1, a latch assembly is strategically located adjacent various flip panels. In addition, the latch assembly 22 of the present invention is used to secure larger panels to display sign 16 such as display panels 106, 108 which overlay sign panel 18.

Figure 3:
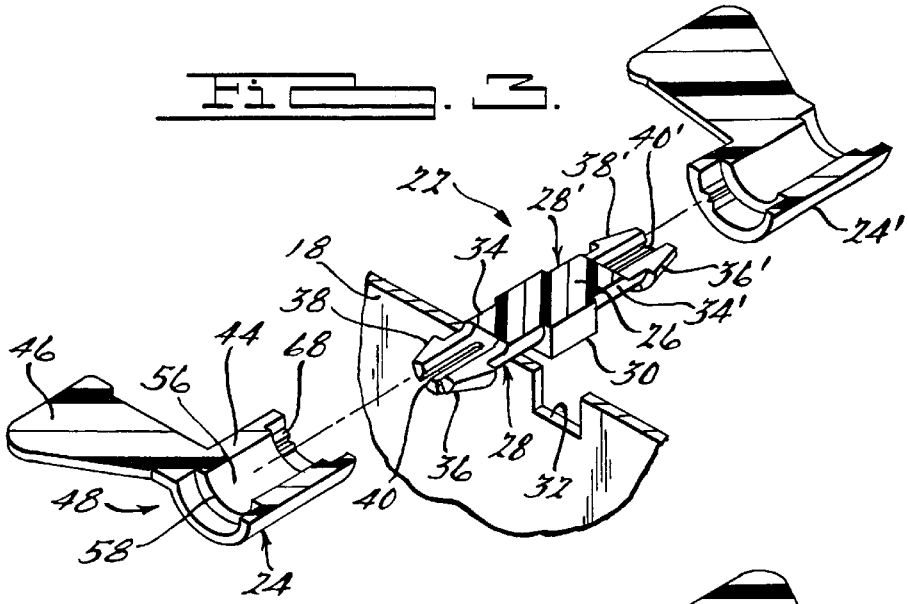
FIG. 3 is an exploded cross-sectional view of the latch assembly shown in FIG. 2.
Figure 4:
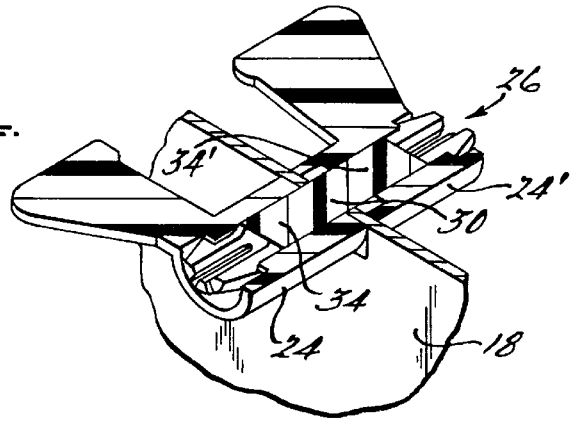
FIG. 4 is a cross-sectional view of the latch assembly similar to that of FIG.3 in an assembled condition.

With reference now to FIGS. 2–8, a first preferred embodiment of the latch assembly in accordance with the present invention is illustrated. Latch assembly 22 is releasably coupled to sign panel 18 and positionable between a lock position as shown in solid lines in FIG. 2 and an unlocked position as shown in phantom lines in FIG. 2. Latches 24, 24', as shown in FIGS. 3 and 4 are rotatably supported or retained on latch pin 26. Latch pin 26 has a pair of cylindrical end portions 28, 28' interconnected by and extending from a square neck portion 30.

With particular reference to FIGS. 3, 7 and 8, neck portion 30 is shaped to fixedly rest in a complementary aperture 32 formed through sign panel 18. As presently preferred, neck portion 30 has a substantially square shaped cross-section and aperture 32 has a substantially square periphery to receive neck portion 30. In this way, means for preventing relative rotation of latch pin 26 with respect to sign panel 18 are provided. While a square cross-section is preferred for neck portion 30 and aperture 32, one skilled in the art will readily appreciate that other cross-sectional configurations could be employed which prevent relative rotation therebetween.

End portion 28, 28' includes a cylindrical-shaped axle portion 34, 34' extending from neck portion 30 and terminating at retaining flange 36, 36'. Retaining flange 36, 36' has a tapered leading edge 38, 38' formed thereon. A plurality of longitudinal slots 40, 40' are formed in end portion 28, 28' and provide a degree of lateral compliance such that latch 24 can be snapped onto and rotatably supported by the axle 34, 34'. In this regard, the longitudinal slots 40, 40' divide end portion 28, 28'0 into six equal sectors.

With reference now to FIG. 9, a modified latch pin 126 is illustrated. Latch pin 126 has a pair of cylindrical end portions 128, 128' interconnected by and extending from a square neck portion 130. Neck portion 130 is shaped to fixedly rest in a complementary aperture 32 formed through side panel 18. End portion 128, 128' includes a cylindrical shaped axle portion 134, 134' extending from neck portion 130' and terminating at retaining flanges 136, 136'. Retaining flange 136, 136' has a tapered leading edge 138, 138' formed thereon. A slot 140, 140' is formed in end portion 128, 128' and provides a degree of lateral compliance such that latch 24 can be snapped onto and rotatably supported by the axle 134, 134'. One skilled in the art will recognize that the number and configuration of the longitudinal slots allows precise control of the radial compliance of the end portion of the latch pin for a given application.

Figure 5:
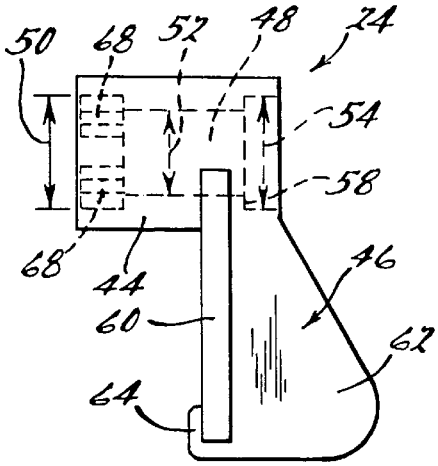
FIG. 5 is a detailed side view of the latch shown in FIG. 2.

With reference now to FIGS. 3 and 5, latch 24 includes a cylindrically shaped hub 44 and a lever 46 extending radially therefrom. Hub 44 has a bore 48 formed therethrough which defines a first diameter 50, a second diameter 52 and a third diameter 54. Latch pin 26 is received in bore 48 such that latch 24 is rotatably supported at second diameter 52. In this regard, the tapered leading edge 38 engage the interior wall 56 so that retaining flange 36 readily passes through bore 48. The first diameter 50 of bore 48 is larger than the second diameter 52 to provide sufficient clearance between hub 44 and neck portion 30. The third diameter 54 of bore 48 is also larger than second diameter 52 to form shoulder 58 in bore 48. Shoulder 58 is adapted to engage retaining flange 36 for axially retaining latch 24 on to latch pin 26.

Figure 6:
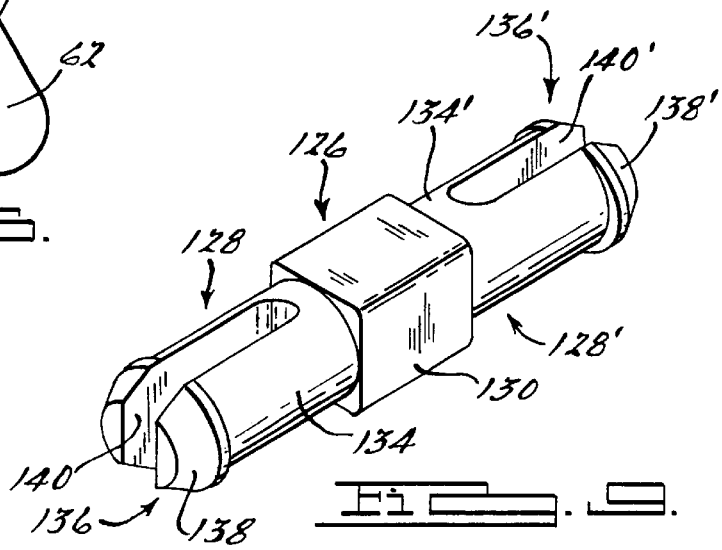
FIG. 6 is a detailed end view of the latch shown in FIG. 2.

With reference to FIG. 6, latch 24 includes a detent 68 formed on an interior wall 70 defined at first diameter 50 of bore 48. As presently preferred, a pair of detents 68 are located on diametrically opposed positions on interior wall 70. Detent 68 is composed of two opposing ramps 72 and an intermediate notch 74. Detent 68 is configured to cooperate with neck 30 to provide a mechanical feature for positively locating latch 24. As latch 24 is rotated, the corner 76 of neck 30 engages the ramp 72 of detent 68. Latch 24 is in the locked position when comer 76 passes the first ramp 72 of detent 68 and rests in intermediate notch 74. As presently illustrated, a pair of detents 68, 68' cooperating with neck 30 provide a feature for positively locating latch 24 at one of four positions. However, one skilled in the art will recognize that the number and orientation of the detents could be adapted for positively locating latch 24 in various orientations. Latch 24 can be rotated on pin 26 to the locked position to engage panels 102, 104 of flip display 100. Latch 24 can also be rotated to an unlocked, or free position to allow reconfiguration of the panels 102, 104 of flip display 100.

With reference to FIG. 5 and 6, lever 46 includes lateral flange 60, a longitudinal handle 62 extending from an upper surface of flange 60 and a nub 64 extending from a bottom surface of flange 60 which functions to urge the flip panels 102, 104 against sign panel 18.

Figure 10:
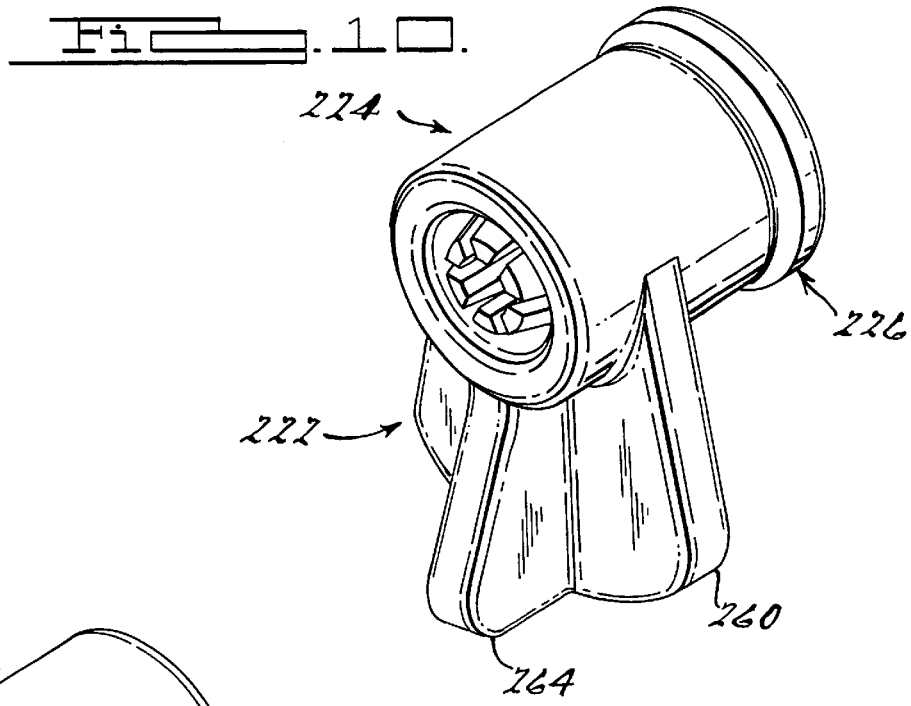
FIG. 10 is a perspective view showing a second preferred embodiment of a latch assembly in accordance with the present invention.
Figure 11:
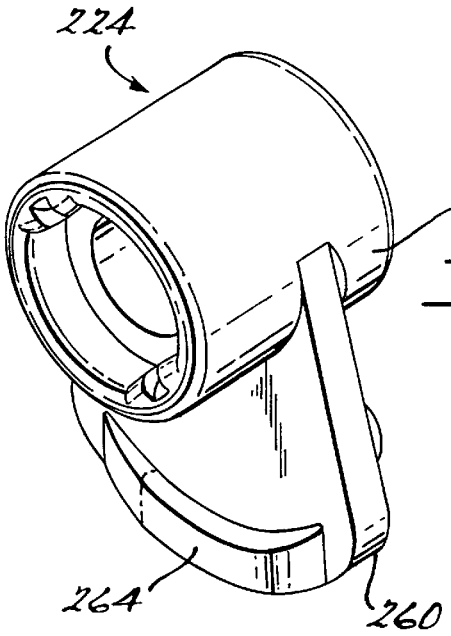
FIG. 11 is a perspective view of the latch shown in FIG. 10.
Figure 12:
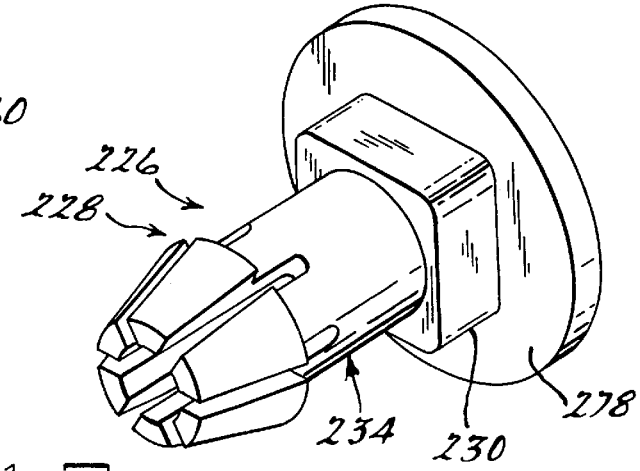
FIG. 12 is a perspective view of the latch pin shown in FIG. 10.

With respect to FIGS. 10–12, a second preferred embodiment of the latch assembly in accordance with the present invention is illustrated. Latch assembly 222 is releasably coupled to a sign panel (not shown) and includes latch 224 rotatably supported and retained by latch pin 226. In this regard, latch pin 226 is designed to support a latch 224 on one side of a sign panel, while minimizing the visual impact on the opposite side thereof. As best seen in FIG. 11, latch 224 is similar to latch 24 as described earlier. Latch 224 alternatively includes enlarged lateral flange 260 in place of lateral flange 60. Enlarged lateral flange 260 extends tangentially from opposite sides of hub 244 to form a pie-shaped flange having an angle of approximately 20° between opposing sides. Additionally, nub 264, which is similar to nub 64 on latch 24, extends along a majority of the outer surface of enlarged lateral flange 260 to urge flip display panels 102, 104 against the sign panel.

As shown in FIG. 12, latch pin 226 is similar to latch pin 26 as described earlier but provides a single axle portion 234 (as opposed to a double axle portion 34, 34') on which latch 24 is rotatably supported. Latch pin 226 has a cylindrical end portion 228 connected to neck 230. Latch pin 226 further includes an enlarged head 278 which extends radially outwardly from the end of neck 230. Enlarged head 278 is sized to be larger than the aperture 32 (as shown in FIG. 3) formed in sign panel 18 such that latch pin 226 may be positively located thereon. Thus, latch pin 220 allows the present invention to be used as a single latch pin where a latching function is only required on one side of a sign assembly. Enlarge head 278 is preferably formed on latch pin 226 as a unitary construction.

From the foregoing description, one skilled in the art will readily recognize that the present invention provides a latch assembly which improves the design, simplifies the manufacture and reduces the cost of assembling various flip panel displays. While the present invention has been described with particular reference to a preferred embodiment, certain changes, modifications and variations may be made without departing from the spirit and scope of the present invention as define by the following claims.

What is claimed is:

1. A latch assembly for releasably retaining a display on a sign panel comprising:

a pin including a neck portion which is adapted to be inserted into an aperture formed in the sign panel and having a cross-section for preventing rotation of said pin and a first axle extending from a first end of said neck portion and having a first retaining flange formed on an end thereof;

a first latch having a bore formed therethrough to receive said first axle such that said first latch is rotatably supported on said first axle between said neck portion and said first retaining flange, said bore having a shoulder formed therein which engages said retaining flange for releasably securing said latch to said pin, said bore opposite said shoulder formed in said first latch having an enlarged diameter to provide clearance for said neck portion of said pin such that said latch rotates on said axle; and wherein said lever further comprises a detent formed on an interior surface defined by said enlarged diameter for releasably retaining said lever in a first location relative to said latch pin.

2. The latch assembly of claim 1 wherein said retaining flange has a tapered leading face.

3. The latch assembly of claim 1 wherein said first axle has a longitudinal slot formed therein.

4. The latch assembly of claim 1 wherein said first latch comprises a hub portion having said bore formed therein and a lever extending from said hub portion.

5. The latch assembly of claim 4 wherein said lever includes a flange portion extending radially outwardly from said hub portion and a handle portion extending longitudinally from an upper surface of said flange portion.

6. The latch assembly of claim 5 wherein said lever further comprises a nub extending from a lower surface of said flange portion.

7. The latch assembly of claim 1 wherein said neck portion has a substantially square cross-section.

8. The latch assembly of claim 1 wherein said pin further comprises an enlarged head portion formed on an end of said neck opposite of axle.

9. A latch assembly for releasably retaining a display on a sign panel comprising:

a pin including a neck portion which is adapted to be inserted into an aperture formed in the sign panel and having a cross-section for preventing rotation of said pin and a first axle extending from a first end of said neck portion and having a first retaining flange formed on an end thereof;

a first latch having a bore formed therethrough to receive said first axle such that said first latch is rotatably supported on said first axle between said neck portion and said first retaining flange a second axle extending from an end of said neck and having a second retaining flange formed thereon; and a second latch having a bore formed therethrough to receive said second axle such that said second latch is rotatably supported on said second axle between said neck portion and said second retaining latch.

10. A latch assembly for releasably retaining a display on a sign panel comprising:

a pin including a neck portion which is adapted to be inserted into an aperture formed in the sign panel and having a square cross-section for preventing rotation of said pin, a first axle extending from a first end of said neck portion and having a first retaining flange with a tapered leading face formed on an end thereof, and a second axle extending from a second end of said neck portion and having a second retaining flange with a tapered leading face formed on an end thereof;

a first latch including a hub portion having a bore and a shoulder formed therein and a lever extending from said hub portion, said bore receiving said first axle and said first retaining flange engaging said shoulder such that said first latch is rotatably supported on said first axle between said neck portion and said first retaining flange; and a second latch including a hub portion having a bore and a shoulder formed therein and a lever extending from said hub portion, said bore receiving said second axle and said second retaining flange engaging said shoulder such that said second latch is rotatably supported on said second axle between said neck portion and said second retaining flange.

11. A sign display comprising:

a sign panel having an aperture formed therein;

a movable display panel;

a latch assembly disposed adjacent said movable display panel for releasably retaining said movable display panel on said sign panel, said latch assembly including a pin having a neck portion which is adapted to be inserted into an aperture formed in said sign panel such that said pin is prevented from rotating relative to said sign panel and a first axle extending from a first end of said neck portion and having a first retaining flange formed on an end thereof;

a first latch having a bore formed therethrough to receive said first axle such that first latch is rotatably supported on said first axle between said neck portion and said first retaining flange, said first latch being positionable between an unlocked position and a locked position, said bore formed in said first latch having a shoulder formed therein which engages said first retaining flange for releasably securing said first latch to said pin, a portion of said bore opposite said shoulder formed in said first latch having an enlarged diameter to provide clearance for said neck portion of said pin such that said latch rotates on said axle; and wherein said lever further comprises a detent formed on an interior surface defined by said enlarged diameter for releasably retaining said lever in a first location relative to said latch pin.

12. The sign display of claim 11 wherein each of said first retaining flange has a tapered leading face.

13. The sign display of claim 11 wherein each of said first axle has longitudinal slots formed therein.

14. The sign display of claim 11 wherein said first latch comprises a hub portion having said bore formed therein and a lever extending from said hub portion.

15. The sign display of claim 14 wherein said lever includes a flange portion extending radially outwardly from said hub portion and a handle portion extending longitudinally from an upper surface of said flange portion.

16. The sign display of claim 15 wherein said lever further comprises a nub extending from a lower surface of said flange portion.

17. The sign display of claim 11 wherein said aperture formed in said sign panel is substantially square, and said neck portion has a substantially square cross-section.

18. The sign display of claim 11 wherein said moveable display panel comprises a panel which overlays said sign panel.

19. The sign display of claim 11 wherein said moveable display panel comprises a flip display having a plurality of flip panels.

20. The sign display of claim 11 wherein said pin further comprises an enlarged head portion formed on an end of said neck opposite said axle.

21. A sign display comprising:

a sign panel having an aperture formed therein;

a movable display panel;

a latch assembly disposed adjacent said movable display panel for releasably retaining said movable display panel on said sign panel, said latch assembly including a pin having a neck portion which is adapted to be inserted into an aperture formed in said sign panel such that said pin is prevented from rotating relative to said sign panel and a first axle extending from a first end of said neck portion and having a first retaining flange formed on an end thereof;

a first latch having a bore formed therethrough to receive said first axle such that first latch is rotatably supported on said first axle between said neck portion and said first retaining flange, said first latch being positionable between an unlocked position and a locked position;

a second axle extending from an end of said neck and having a second retaining flange formed thereon; and a second latch having a bore formed thereon to receive said second axle such that said second latch is rotatably supported on said second axle between said neck portion and second retaining flange.

* * * * *

UNITED STATES PATENT AND TRADEMARK OFFICE

CERTIFICATE OF CORRECTION

PATENT NO. : 6,546,655 B1 
DATED : April 15, 2003
INVENTOR(S) : Brian J. Hillstrom It is certified that error appears in the above-identified patent and that said Letters Patent is hereby corrected as shown below:

Title page,
Item [57], ABSTRACT,
Line 4, after "disposed" insert -- at --;

Column 2,
Line 47, "," should be -- . --;

Column 3,
Line 35, "28,28'0" should be -- 28,28' --;

Column 4,
Line 8, "comer" should be -- corner --;
Line 20, "FIG." should be -- FIGS. --;
Line 64, "define" should be -- defined --;

Column 5,
Line 52, after "flange" insert -- ; --;
Line 52, begin new paragraph starting at "a second axle".

Signed and Sealed this

Thirtieth Day of September, 2003

JAMES E. ROGAN
*Director of the United States Patent and Trademark Office*